United States Patent [19]

Anderson

[11] 4,016,913

[45] Apr. 12, 1977

[54] HOLDING DEVICE FOR SCREW DRIVERS AND THE LIKE

[76] Inventor: Raymond L. Anderson, 1419 Lexington St., Covington, Ky. 41016

[22] Filed: Apr. 12, 1976

[21] Appl. No.: 676,222

[52] U.S. Cl. ..... 145/52; 145/50 D

[51] Int. Cl.[2] ..... B25B 15/00; B25B 23/08

[58] Field of Search ..... 145/50 D, 52

[56] References Cited

UNITED STATES PATENTS

| | | | |
|---|---|---|---|
| 351,751 | 11/1886 | Douglas | 145/52 |
| 1,417,995 | 5/1922 | Hilton | 145/52 |
| 1,457,457 | 6/1923 | Peyer | 145/52 |
| 1,698,521 | 1/1929 | Wood | 145/52 |
| 1,712,196 | 5/1929 | Burger et al. | 145/52 |
| 3,245,446 | 4/1966 | Morifuji | 145/50 D |

FOREIGN PATENTS OR APPLICATIONS

| | | | |
|---|---|---|---|
| 749,071 | 5/1933 | France | 145/52 |
| 1,009,349 | 3/1952 | France | 145/52 |
| 1,344,471 | 10/1963 | France | 145/52 |

*Primary Examiner*—Al Lawrence Smith
*Assistant Examiner*—J. T. Zatarga
*Attorney, Agent, or Firm*—Melville, Strasser, Foster & Hoffman

[57] ABSTRACT

A holding device to be used with screw drivers, nut drivers and other tools to hold or attach any type of fastener to the appropriate driver. The holding device comprises a sleeve adapted to fit over the shank portion of a driver, a pair of diverging arms at the forwardmost end of the sleeve, and a pair of springs extending between the arms adapted to receive the head and grip the shank of a fastener.

15 Claims, 12 Drawing Figures

A
B
C
D

HOLDING DEVICE FOR SCREW DRIVERS AND THE LIKE

BACKGROUND OF THE INVENTION

1. Field of the Invention

This invention relates to improvements in means for inserting and removing fasteners, such as screws, bolts and nuts, and more particularly to a holding device or attachment for screw drivers and the like which is operatively mounted on the shank thereof and which assists the user in holding, piloting and starting a screw as well as in the removal thereof.

2. Description of the Prior Art

The prior art has long sought to develop a satisfactory holding attachment for screw drivers and the like which will assist the user in holding, piloting and starting a screw as well as with the removal thereof. Many expedients have been used, including jaw-like devices, latch means and resilient retainers of the type shown in United States Letters Patent No. 3,245,446. However, the prior art has been unsuccessful in such attempts.

SUMMARY OF THE INVENTION

The present invention provides a holding device for a screw driver and the like for inserting and removing screws, bolts and nuts and which is equally adapted for operation on wood screws, metal screws with round, square, hexagonal or other forms of heads and nuts of various shapes, and which will simultaneously hold a screw with a washer next to the head.

Briefly, the driver is provided with a driving end, a shank portion and a fastener holding device mounted thereon. The fastener holding device comprises a sleeve adapted to fit over the shank portion, a pair of diverging arms at the forwardmost end of the sleeve, and a pair of springs extending between the arms adapted to receive the head and grip the shank of a fastener. The sleeve is shiftable longitudinally of the driver shank and the springs at the forwardmost end of the sleeve. Accordingly, the pair of springs engages the shank of a fastener beneath its head to hold the fastener in place during the installation and removal thereof.

In a preferred embodiment, a compression spring is located on the shank to urge the sleeve forwardly thereof.

In still a further embodiment a compression spring is located on the shank between the sleeve and the pair of springs to urge the sleeve rearwardly thereof.

BRIEF DESCRIPTION OF THE DRAWINGS

FIGS. 7A through 7D are fragmentary side elevational views of a screw driver with a holding device in accordance with the present invention showing the operational of sequence thereof.

DESCRIPTION OF THE PREFERRED EMBODIMENTS

Figures 1, 1A, 2, 3, 4, 5A, 5B, 6, 7:
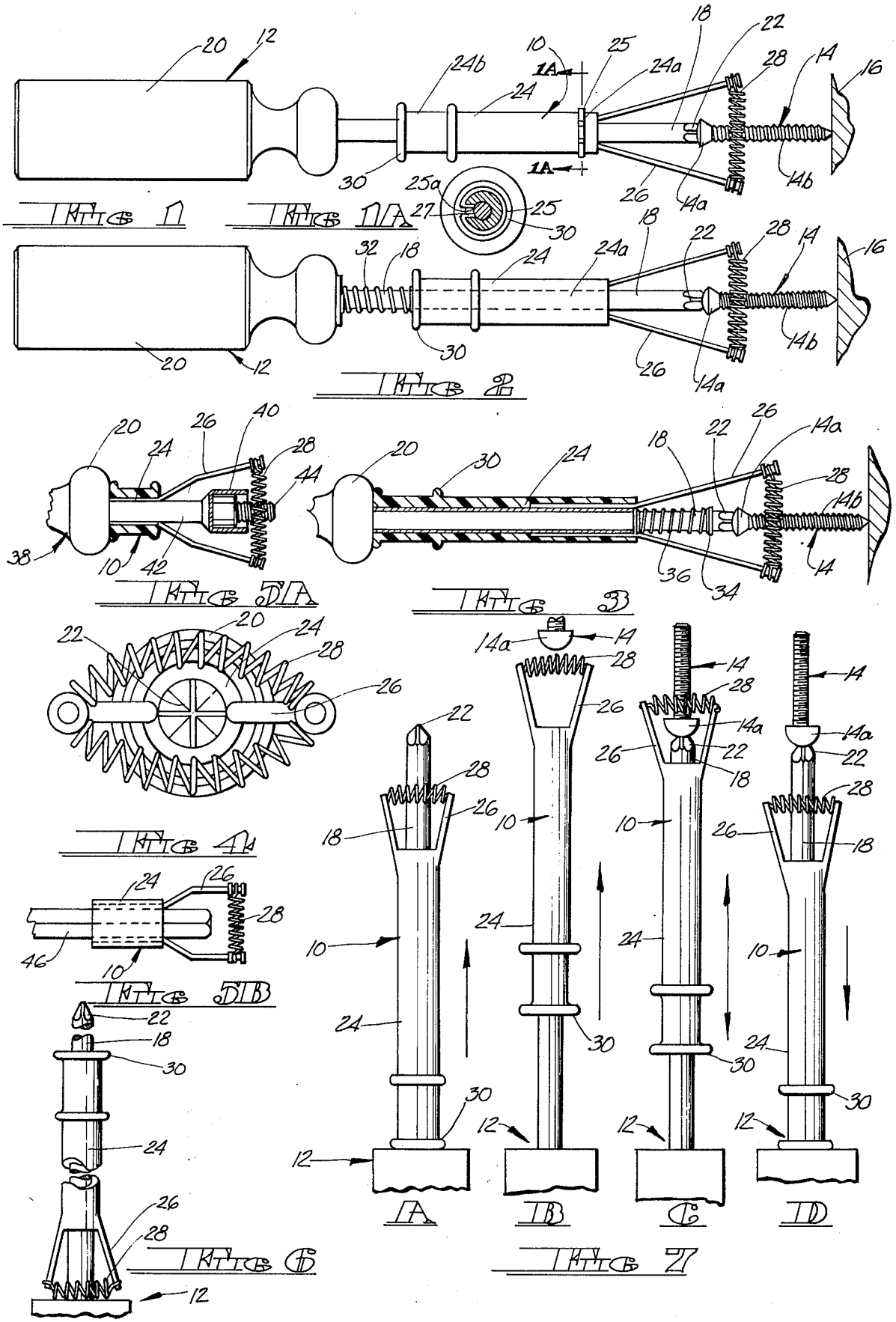
FIG. 1 is a side elevational view of a screw driver with a fastener holding attachment in accordance with the teachings of the present invention.
FIG. 1A is a cross sectional view taken on the line 1A—1A of FIG. 1.
FIG. 2 is a view similar to FIG. 1 but also showing a compression spring located on the shank between the sleeve and the handle to urge the sleeve forwardly.
FIG. 3 is a partial cross sectional view through a screw driver with a fastener holding attachment showing a compression spring located on the shank between the sleeve and the pair of springs to urge the sleeve rearwardly against the handle.
FIG. 4 is an enlarged end view of a screw driver utilizing the holding device of the present invention showing the pair of springs.
FIG. 5A is a view similar to FIG. 3 wherein the fastener driving end comprises a nut driver.
FIG. 5B is a view similar to FIG. 3 wherein the driver comprises an Allen wrench.
FIG. 6 is a fragmentary side elevational view of a screw driver with a holding device in accordance with the present invention showing the devices in the stored position.

Turning first to FIG. 1, the present invention provides a holding device 10 to be used primarily with different types of screw drivers 12 to hold or attach any type of fastener, such as the screw 14 to the appropriate screw driver 12 at any angle while placing or removing screws and parts or materials 16. The holding device 10 may be manufactured as part of the screw driver 12 or as a separate unit to be used on different types of screw drivers 12, nut drivers, Allen wrenches, or other tools. The holding device 10 is simple, effective and inexpensive and is capable of use with screw drivers, nut drivers, Allen wrenches and other tools for inserting and removing fasteners such as screws, bolts and nuts, and is equally adapted for operation on wood screws, metal screws with round, square and hexagonal or other forms of heads and nuts of various shapes, and will simultaneously hold a screw with a washer next to the head.

The conventional screw driver 12 shown in FIG. 1 includes a shank 18 terminating at one end in a handle 20 and at the other end in a fastener driving portion 22.

The holding attachment 10 comprises a sleeve 24 adapted to fit over the shank portion of various tools, such as the shank 18 of the screw driver 12. If necessary or desired, suitable means may be provided to hold the sleeve 24 on the shank 18. For example, a series of indentations may be provided in the sleeve 24 or a C clip 25 may be mounted around the sleeve 24 with the ends 25*a* thereof extending through the grooves 27 in the sleeve 24 against the shank 18. A pair of diverging arms 26 is provided at the forwardmost end 24*a* of the sleeve 24 and a pair of springs 28 extends between the diverging arms 26. The pair of springs 28 is adapted to receive the head 14*a* and grip the shank 14*b* of a screw or bolt 14. The sleeve 24 is shiftable longitudinally of the shank 18 and the pair of springs 28 at the forwardmost end 24*a* of the sleeve 24. A finger gripping ridge (or ridges) 30 is provided on the sleeve 24 so that it may be guided along the shank 18.

As best seen in FIG. 2, a compression spring 32 is located on the shank 18 between the rearwardmost end 24*b* of the sleeve 24 and the handle 20 to urge the sleeve 24 forwardly thereof. In practice when the sleeve 24 is urged forwardly, the fastener or screw driving portion 22 is contiguous with the head 14*a* of the screw 14.

As best seen in FIG. 3, a ridge or flange 34 is provided immediately prior to the fastener or screw driving portion 22. A compression spring 36 is located on the shank 18 of the screw driver 12 between the forwardmost end 24*a* of the sleeve 24 and the ridge or flange 34 and acts to urge the rearmost portion 24*b* of the sleeve 24 against the handle 20. In this way the fastener or screw driving portion 22 is always substantially in position to be contiguous with the head 14*a* of a screw 14 which is inserted between the pair of springs 28.

FIG. 5A is merely an exemplary showing of the holding device 10 as used with a nut driver 38 having a nut driving portion 40 on the end of a shank 42 for driving the nut 44.

FIG. 5B is merely an exemplary showing of the holding device 10 as used with an Allen wrench 44 having a shank 46.

FIG. 6 discloses how the holding attachment 10 of the present invention may be stored on a tool, such as the screw driver 12, by merely reversing the sleeve 24 so that the pair of springs 28 is contiguous with the handle portion 20 of the screw driver 12.

The operation of a tool with the holding attachment 10 of the present invention is best seen by reference to the screw driver 12 in FIGS. 7A through 7D. As shown in FIG. 7A, the sleeve 24 of the holder 10 is slidably received on the shank 18 of the screw driver 12. The holder 10 is then pushed forward, as indicated by the arrow in FIG. 7B until the pair of springs 28 is clear of the screw driving portion 22 so that the head 14*a* of a screw 14 may be pushed through the pair of springs 28 so that the springs 28 will grip the shank 14*b* of the screw 14. The screw 14 is then placed in a work piece by moving the sleeve 24 back toward the handle 20 of the screw driver 12 so that the head 14*a* of the screw 14 comes into engagement with the screw driving portion 22 of the shank 18. The screw 14 is then initially guided into the work piece as the screw driver 12 is rotated. When the screw 14 is sufficiently within the work piece, the screw holding attachment may be withdrawn so that it is clear of the screw 14, as shown in FIG. 6D. This is accomplished by moving the sleeve 24 in the direction of the arrow as indicated.

The foregoing description is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention as claimed.

I claim:

1. A driver having a fastener driving end, a shank portion and a fastener holding device mounted thereon, said fastener holding device comprising a sleeve adapted to fit over said shank portion, a pair of diverging arms at the forward most end of said sleeve, and a pair of coiled springs extending the length between said arms, each spring having two ends each connected to a respective one of said arms and adapted to receive the head and grip the shank of a fastener, said sleeve being shiftable longitudinally of said screw driver shank, whereby said pair of springs engages the shank of a fastener beneath its head to hold the fastener in place during both the installation and the removal thereof.

2. The driver according to claim 1, wherein a compression spring is located on said shank to urge said sleeve forwardly thereof.

3. The driver according to claim 1, wherein a compression spring is located on said shank to urge said sleeve rearwardly thereof.

4. The driver according to claim 1, wherein a finger gripping ridge is provided on said sleeve.

5. The driver according to claim 1, wherein means are provided to hold said sleeve on said shank.

6. The driver according to claim 1, wherein said fastener driving end comprises a phillips head.

7. The driver according to claim 1, wherein said fastener driving end comprises a nut driver.

8. The driver according to claim 1, wherein said fastener driving end comprises an Allen wrench.

9. A screw driver having a shank terminating at one end in a handle portion and at the other end in a fastener driving portion, and a fastener holding device mounted thereon, said fastener holding device comprising a sleeve adapted to fit over said shank, a pair of diverging arms at the forward most end of said sleeve, and a pair of coiled springs extending the length between said arms, each spring having two ends each connected to a respective one of said arms and adapted to receive the head and grip the shank of a fastener, said sleeve being shiftable longitudinally of said screw driver shank, whereby said pair of springs engages the shank of a fastener beneath its head to hold the fastener in place during both the installation and the removal thereof.

10. The screw driver according to claim 9, wherein a compression spring is located on said shank between said sleeve and said handle portion to urge said sleeve forwardly thereof.

11. The screw driver according to claim 9, wherein a ridge is provided on said shank adjacent said fastener driving end portion, and wherein a compression spring is located on said shank between said sleeve and said ridge to urge said sleeve rearwardly thereof.

12. The screw driver according to claim 9, wherein a finger ridge is provided on said sleeve.

13. The screw driver according to claim 9, wherein said fastener driving end portion comprises a phillips head.

14. The screw driver according to claim 9, wherein said fastener driving end portion comprises a nut driver.

15. A holding device to be used with tools such as screw drivers, nut drivers, Allen wrenches and the like, and to hold or attach any type of fastener to the appropriate driver at any angle while placing or removing fasteners in parts or materials comprising a sleeve adapted to fit over a shank portion of the driver, a pair of diverging arms at the forwardmost end of said sleeve, and a pair of coiled springs extending the length between said arms, each spring having two ends each connected to a respective one of said arms and adapted to receive the head and grip the shank of a fastener, said sleeve being shiftable longitudinally of said driver shank, whereby said pair of springs engages the shank of a fastener beneath its head to hold the fastener in place during both the installation and the removal thereof.

* * * * *